US008463165B2

(12) United States Patent
Kozasa et al.

(10) Patent No.: US 8,463,165 B2
(45) Date of Patent: Jun. 11, 2013

(54) INTERMEDIATE TRANSFER BELT, IMAGE FORMING METHOD, FOR USE IN ELECTROPHOTOGRAPHY

(75) Inventors: Momoko Kozasa, Atsugi (JP); Toshiyuki Kabata, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 600 days.

(21) Appl. No.: 12/699,390

(22) Filed: Feb. 3, 2010

(65) Prior Publication Data

US 2010/0196062 A1 Aug. 5, 2010

(30) Foreign Application Priority Data

Feb. 5, 2009 (JP) ..... 2009-024452
Jun. 24, 2009 (JP) ..... 2009-149672

(51) Int. Cl.
*G03G 15/01* (2006.01)
*G03G 15/20* (2006.01)

(52) U.S. Cl.
USPC ..... 399/302; 399/308

(58) Field of Classification Search
USPC ..... 399/302, 308
See application file for complete search history.

(56) References Cited

U.S. PATENT DOCUMENTS

| | | | | |
|---|---|---|---|---|
| 6,643,487 | B1 * | 11/2003 | Shimmura | 399/302 |
| 7,239,834 | B2 | 7/2007 | Kuramoto et al. | |
| 7,691,791 | B2 * | 4/2010 | Usami | 508/107 |
| 2004/0013451 | A1 * | 1/2004 | Fukao et al. | 399/301 |
| 2010/0300604 | A1 * | 12/2010 | Goss et al. | 156/154 |

FOREIGN PATENT DOCUMENTS

| | | |
|---|---|---|
| JP | 3210191 | 7/2001 |
| JP | 2004-361694 | 12/2004 |
| JP | 2005-316231 | 11/2005 |
| JP | 3753909 | 12/2005 |

* cited by examiner

*Primary Examiner* — David Gray
*Assistant Examiner* — Andrew Do
(74) *Attorney, Agent, or Firm* — Cooper & Dunham LLP

(57) ABSTRACT

An intermediate transfer belt for use in electrophotography including plural linear convexities is provided. The plural linear convexities have a height of from 0.01 to 1 μm and a width of from 0.5 to 5 μm.

11 Claims, 4 Drawing Sheets

INTERMEDIATE TRANSFER BELT, IMAGE FORMING METHOD, FOR USE IN ELECTROPHOTOGRAPHY

BACKGROUND OF THE INVENTION

1. Field of the Invention

The present invention relates to an intermediate transfer belt, an image forming method, and an image forming apparatus using the intermediate transfer belt for use in electrophotography.

2. Discussion of the Related Art

In electrophotographic image forming apparatuses, seamless belts are used with various functions and uses, such as fixing belt, transfer belt, paper conveyance belt, and intermediate transfer belt.

Intermediate transfer belt is generally used in full-color electrophotographic image forming apparatuses. Toner images of cyan, magenta, yellow, and black each are transferred from a photoreceptor onto an intermediate transfer belt to form a composite full-color toner image thereon. The composite full-color toner image is then transferred onto a transfer medium such as paper.

Demand for intermediate transfer belt has grown in accordance with recent colorization of copiers. Intermediate transfer belts generally include materials such as thermoplastic resins, thermosetting resins, rubbers, and elastomers.

On the other hand, intermediate transfer belts are generally used in electrophotographic image forming apparatuses in which developing devices are arranged in tandem (hereinafter "tandem electrophotographic image forming apparatuses") to increase printing speed.

In tandem electrophotographic image forming apparatus, intermediate transfer belt is required not to deform through image formation so as not to cause color drift. Intermediate transfer belt is also required to be strong and durable enough to withstand repeated use. Because intermediate transfer belt is also required to be flame-resistant, polyimide resins and polyamide-imide resins have been preferably used therefor. In particular, polyimide resins have been preferably used from the viewpoint of creep deformation property and durability.

In an electrophotographic image formation, some toner particles may remain on an intermediate transfer belt without being transferred onto a transfer medium. Therefore, a cleaning device for removing such residual toner particles from the intermediate transfer belt is needed.

One of the most effective ways to remove residual toner particles from an intermediate transfer belt is to scrape the residual toner particles off by pressing an edge of a cleaning blade against the surface of the intermediate transfer belt.

Intermediate transfer belt is generally provided with electric properties that are required for forming latent images and transferring toner images. However, the electric properties deteriorate with repeated image formation because the cleaning blade is constantly pressed against the intermediate transfer belt, shortening the lifespan of the intermediate transfer belt. As a result, abnormal images are likely to be produced.

Because of the widespread use of oilless fixing systems, recent toners typically include waxes and soft materials which are capable of being softened easily for the purpose of reducing the fixable temperature, which leads to energy saving. Such waxes and soft materials are likely to adhere to an intermediate transfer belt and are gradually formed into film with repeated image formation (this phenomenon is hereinafter referred to as "filming"), thereby degrading electric properties of the intermediate transfer belt.

Images are formed on not only typical copying papers but also coated paper and printing paper that include large amounts of loading materials such as talc, kaolin, and calcium carbonate. Loading materials are likely to adhere to an intermediate transfer belt when images are transferred from the intermediate transfer belt onto such papers and the adhered loading materials are likely to cause filming.

In attempting to suppress both the damage caused by pressure from the cleaning blade and the occurrence of filming caused by toner component materials and loading materials, one proposed approach involves reducing the surface friction coefficient of an intermediate transfer belt. For example, Japanese Patent Application Publication No. (hereinafter "JP-A") 08-95455 and Japanese Patent No. 3753909 each propose a lubricant applicator for applying a lubricant to the surface of an intermediate transfer belt to reduce the surface friction coefficient thereof.

An image forming apparatus employing such a lubricant applicator is able to form high-quality images at low printing speeds. However, when the printing speed is increased in accordance with recent demand, abnormal images with undesired strips may be formed in continuous image forming operation. This is because a portion of the intermediate transfer belt on which an image exists has a higher surface friction coefficient than a portion on which no image exists, and therefore toner component materials and loading materials are likely to adhere to the portion on which an image exists, forming films thereon. In this case, little lubricant exists on the portion of the intermediate transfer belt having a higher surface friction coefficient. It is apparent from this fact that lubricant should be uniformly and reliably adhered to an intermediate transfer belt to form high-quality images at high printing speeds.

In attempting to adhere more lubricant to an intermediate transfer belt, one proposed approach involves roughening a surface of an intermediate transfer belt with abrasive paper, abrasive agent, etc., as described in JP-A 2005-316231 and JP-A 2004-361694.

JP-A 2005-316231 describes a method which forms concavities on an intermediate transfer belt in a circumferential direction by applying an abrasive agent to a circumferential surface of the intermediate transfer belt and rotating the intermediate transfer belt with an abrasive brush rotating in a direction parallel to the direction of conveyance of the intermediate transfer belt.

JP-A 2004-316194 describes a method which forms concavities on an intermediate transfer belt by abrading the intermediate transfer belt by setting it on an abrading mandrel.

These methods have a disadvantage that lubricant is likely to accumulate in the concavities. As a result, only a part of a surface of an intermediate transfer belt is supplied with the lubricant. There is another disadvantage that not only lubricant but also substances which may cause filming are likely to accumulate in the concavities. Additionally, toner images may be unevenly transferred from such an intermediate transfer belt due to the presence of the concavities.

SUMMARY OF THE INVENTION

Accordingly, exemplary embodiments of the present invention provide an intermediate transfer belt which has reliable electric properties and abrasion resistance.

Exemplary embodiment of the present invention also provide an image forming method and an image forming apparatus which provide high quality full-color images without image defect, density unevenness, and color unevenness at high printing speeds for an extended period of time.

These and other features and advantages of the present invention, either individually or in combinations thereof, as hereinafter will become more readily apparent can be attained by exemplary embodiments described below.

One exemplary embodiment provides an intermediate transfer belt including plural linear convexities having a height of from 0.01 to 1 μm and a width of from 0.5 to 5 μm.

Another exemplary embodiment provides an image forming method which includes sequentially forming plural single-color toner images on at least one image bearing member; sequentially transferring the single-color toner images from the at least one image bearing member onto the above intermediate transfer belt to form a composite toner image in which the single-color toner images are superimposed on one another, while supplying a metallic soap to the intermediate transfer belt; and transferring the composite toner image from the intermediate transfer belt onto a recording medium.

Yet another exemplary embodiment provides an image forming apparatus which includes at least one image bearing member configured to bear single-color toner images, and the above intermediate transfer belt. The single-color toner images are sequentially transferred from the at least one image bearing member onto the intermediate transfer belt to form a composite toner image in which the single-color toner images are superimposed on one another, and the composite toner image is transferred onto a recording medium.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
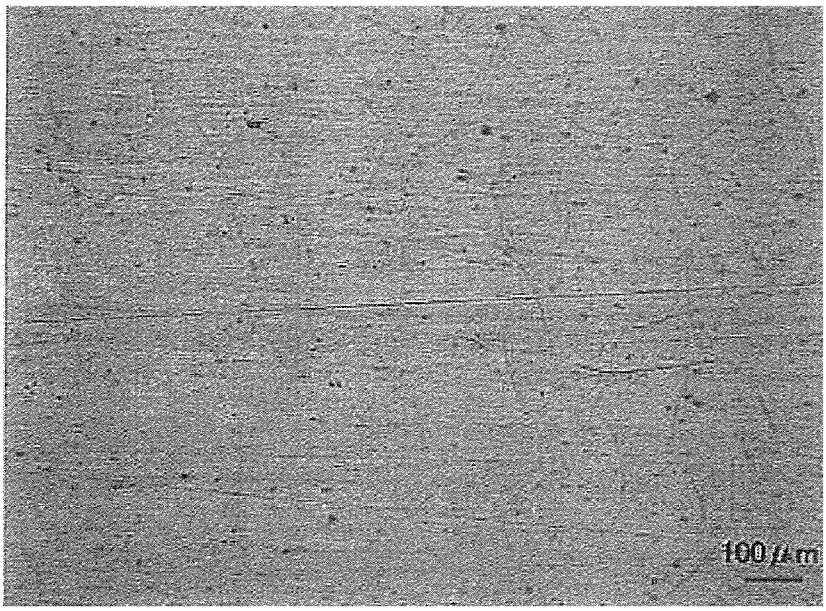
FIG. 1 is a photograph of a surface of an intermediate transfer belt according to the present invention, obtained using a laser microscope.

The inventors of the present invention carefully observed how a lubricant is adhered to an intermediate transfer belt when a brush is pressed against a bar-like block of the lubricant and the granulated lubricant is supplied to the intermediate transfer belt. As a result of the observation, the inventors have found the following.

When the intermediate transfer belt has convexities on its surface, supply of the lubricant is accelerated at the periphery of the edges the convexities.

When the apex of each of the convexities has too wide an area, in other words, the intermediate transfer belt is relatively flat and convexities exist sparsely, only limited areas on the intermediate transfer belt are supplied with the lubricant.

By contrast, when the apex of each of the convexities has a relatively narrow area and a linear profile (including a straight-line profile and a gently-curved-line profile), the intermediate transfer belt is efficiently supplied with the lubricant. Additionally, when the convexities intersect one another to form concavities surrounded by the convexities, the intermediate transfer belt is efficiently supplied with the lubricant.

Accordingly, the present invention provides an intermediate transfer belt including plural convexities having a linear profile (hereinafter "linear convexities") having a height of from 0.01 to 1 μm and a width of from 0.5 to 5 μm.

Owing to the presence of the linear convexities on the intermediate transfer belt, an appropriate amount of a lubricant (e.g., a metallic soap) can be reliably adhered thereto and the surface friction coefficient of the intermediate transfer belt is effectively reduced. As a result, both the damage caused by pressure from cleaning blade and the occurrence of filming are suppressed. Such an intermediate transfer belt has stable electrostatic properties, improved abrasion resistance, and a long lifespan.

Additionally, when the plural linear convexities intersect one another to form plural concavities surrounded by the linear convexities and the average area of the plural concavities surrounded by the linear convexities is from 1,000 to 30,000 $\mu m^2$, lubricant can be uniformly applied to the intermediate transfer belt without causing image defect, image density unevenness, and color unevenness.

The present invention also provides an image forming method which includes sequentially forming plural single-color toner images on at least one image bearing member; sequentially transferring the single-color toner images from the at least one image bearing member onto the above intermediate transfer belt to form a composite toner image in which the single-color toner images are superimposed on one another, while supplying a metallic soap to the intermediate transfer belt; and transferring the composite toner image from the intermediate transfer belt onto a recording medium.

It is preferable that the metallic soap is a mixture of a zinc stearate and a zinc palmitate. In this case, the surface friction coefficient of the intermediate transfer belt is more controllable.

The present invention also provides an image forming apparatus which includes at least one image bearing member configured to bear single-color toner images, and the above intermediate transfer belt. The single-color toner images are sequentially transferred from the at least one image bearing member onto the intermediate transfer belt to form a composite toner image in which the single-color toner images are superimposed on one another, and the composite toner image is transferred onto a recording medium. Such an image forming apparatus exhibits high transfer efficiency regardless of surface profile of the image bearing member (e.g., a photoreceptor) and the recording medium. Accordingly, high quality full-color images without image defect, image density unevenness, and color unevenness are produced.

In the image forming apparatus according to the present invention, a lubricant such as a metallic soap can be uniformly applied to the intermediate transfer belt even when images are formed at a high linear speed of 400 mm/sec or more under low-temperature and low-humidity conditions. Therefore, high quality full-color images without image defect, image density unevenness, and color unevenness are produced.

Additionally, the image forming apparatus according to the present invention exhibits high transfer efficiency regardless of surface profile of the image bearing member (e.g., photoreceptor) and the recording medium even when images are formed at a high linear speed of 400 mm/sec or more. Therefore, high quality full-color images without image defect, image density unevenness, and color unevenness are produced.

Exemplary embodiments of the present invention are described in detail below.

The intermediate transfer belt of the present invention is in the form of a seamless belt. Specific examples of usable materials for the seamless belt include, but are not limited to, thermoplastic and thermosetting resins having conductivity such as polyimide resins, polyamide-imide resins, polyurethane resins, polypropylene resins (PP), polyethylene resins (PE), ethylene propylene resins (EP), polyamide resins, polycarbonate resins (PC), polyether sulfone resins (PES), polyester resins (SP, UP), ethylene tetrafluoride resins (PTFE), polyvinyl fluoride resins, ethylene-tetrafluoroethylene resins (ETFE), chlorotrifluoroethylene resins, hexafluoropropylene resins, acrylic resins (PMMA), epoxy resins (EP), polypyromellitimide resins, melamine resins, phenol resins, urethane resins (PU), silicone resins (SI), ethylene-propylene-diene resins (EPDM). Among these resins, the seamless belt preferably comprises a polyimide resin from the viewpoint of creep deformation property and durability. All types of polyimide resins such as thermoplastic types, solvent-soluble types, and thermosetting types are usable. Among various polyimide resins, thermosetting type polyimide resins are preferable. Thermosetting type polyimide resins are formed by subjecting a solution (i.e., a polyimide varnish) containing an organic polar solvent and a polyimide precursor to thermal hardening. Such solutions are suitable for the needs for blending with various materials, especially resistance controlling agents for controlling electric resistance.

Linear convexities are formed on a surface of the intermediate transfer belt either at the time a polyimide resin is being formed by thermal hardening or after a polyimide resin has been already formed into the intermediate transfer belt.

An exemplary method of forming linear convexities on a surface of the intermediate transfer belt at the time a polyimide resin is being formed by thermal hardening includes forming linear concavities on a support and forming a film of a polyimide resin thereon. In this case, the concave profile of the support is transferred onto a surface of the resulting intermediate transfer belt (i.e., the polyimide resin) so that linear convexities are formed thereon. Suitable methods for forming a film of a polyimide resin include, but are not limited to, centrifugal molding, roll coating, blade coating, ring coating, dipping, spray coating, dispenser coating, and die coating. Among these methods, centrifugal molding is preferable. For example, in a case in which plural linear concavities having a depth of from 0.01 to 1 μm and a width of from 0.5 to 5 μm are formed on an inner surface of a centrifugal mold (i.e., a support) while the average area surrounded by the linear concavities is controlled to from 1,000 to 30,000 $\mu cm^2$, plural linear convexities having a depth of from 0.01 to 1 μm and a width of from 0.5 to 5 μm are formed on a surface of the resulting intermediate transfer belt while the average area surrounded by the linear convexities is from 1,000 to 30,000 $\mu cm^2$.

Linear Concavities can be formed on a mold by cutting processing, grinding processing, electrical processing, and sputtering, for example. Because microfabrication performed by cutting processing, grinding processing, or electrical processing is expensive, sputtering is preferable, which can perform uniform microfabrication at low cost.

An exemplary method of forming linear convexities on a surface of the intermediate transfer belt which has been already formed includes pressing a mold having linear concavities against a surface of the intermediate transfer belt while heating the intermediate transfer belt. In this case, linear convexities are formed owing to thermoplastic property of the intermediate transfer belt. Other exemplary methods of forming linear convexities on a surface of the intermediate transfer belt which has been already formed include cutting processing, grinding processing, and electrical processing.

The linear convexities are defined as convexities having a linear profile. The linear profile may be, for example, a straight-line profile, a gently-curved-line profile, or a combination of a gently-curved-line profile and a short straight-line profile. Such a combination is most preferable because lubricant can be more uniformly adhered thereto.

The convexities preferably have a height of from 0.01 to 1 μm and a width of from 0.5 to 5 μm, and more preferably a height of from 0.02 to 0.1 μm and a width of from 1 to 2 μm.

When the height is too small, in other words, the convexities are too short, it means that the surface of the intermediate transfer belt is so flat that the surface cannot be efficiently provided with a lubricant which typically includes zinc stearate having a molecular length of about 0.01 μm. By contrast, when the height is too large, in other words, the convexities are too high, the convexities act as extraneous substances existing on the surface of the intermediate transfer belt, thereby producing abnormal images. In order to effectively supply the surface of the intermediate transfer belt with lubricant and not to produce abnormal images, the convexities preferably have a height of from 0.02 to 0.1 μm as described above.

When the width is too small, it means that the convexities are too thin and brittle. Such convexities are likely to brake and thereby causing abnormal images. When the width is too large, it means that the apexes of the convexities are so wide that the surface of the intermediate transfer belt is substantially flat. Such a substantially flat surface cannot be effectively provided with lubricant.

The convexities having a width of from 1 to 2 μm are durable and contribute to efficient provision of lubricant to the intermediate transfer belt.

The linear convexities may intersect one another while forming a pattern such as a reticular pattern, a honeycomb pattern, and a random pattern. Preferably, the linear convexities are provided so as to form a pattern having oblique components with an angle of from 30° to 60° relative to the circumferential direction of the intermediate transfer belt, such as a honeycomb pattern and a random pattern, so as to prevent the occurrence of filming.

Each of the plural concavities surrounded by the linear convexities preferably has an average area of from 1,000 to 30,000 $\mu cm^2$, and more preferably from 3,000 to 15,000 $\mu cm^2$.

Each of the linear convexities preferably has the same height. However, each of the linear convexities may have a different height or a part of the linear convexities may be absent. Even when a part of the linear convexities is absent, the average area of the concavities can be calculated assuming that there is no absence of the linear convexity.

When the average area of the concavities surrounded by the linear convexities is too small, the amount of lubricant supplied to the intermediate transfer belt may be so large that the surface gloss of the intermediate belt may decrease. As a result, what is called a process control operation, which controls image forming conditions by measuring image density of an image formed on the intermediate transfer belt, is affected. Also, there is a possibility that the lubricant may act as an extraneous substance which causes abnormal images. When the average area of the concavities surrounded by the linear convexities is too large, the intermediate transfer belt is insufficiently provided with the lubricant when the linear speed is high. As a result, the lubricant is unevenly applied to the intermediate transfer belt, thereby producing abnormal images.

The profile of the convexities can be measured using a laser microscope, an optical interferometric microscope, an atomic force microscope (AFM), or a scanning electron microscope (SEM). FIG. 1 is a photograph of a surface of an intermediate transfer belt according to the present invention, obtained using a laser microscope.

Figure 2:
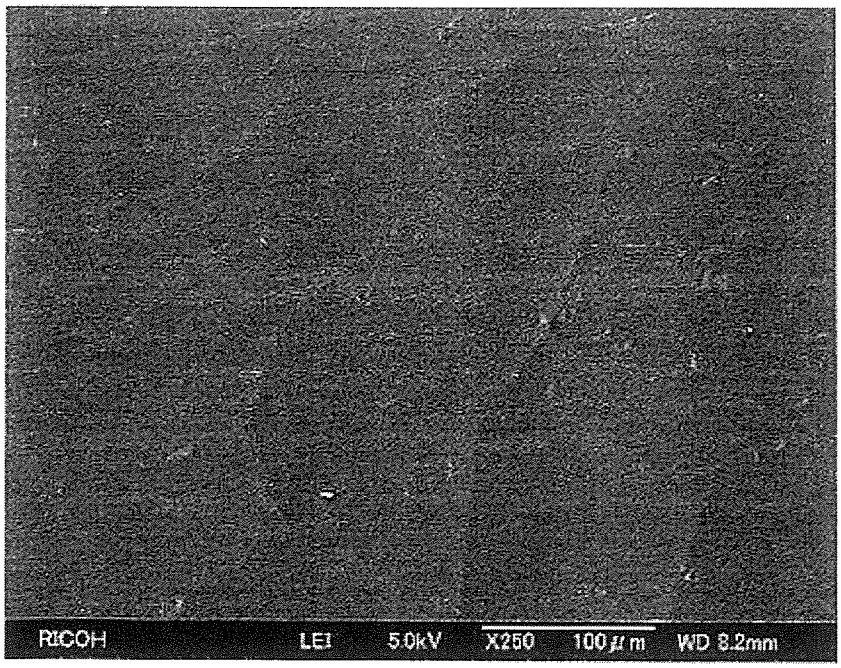
FIG. 2 is a photograph of a surface of an intermediate transfer belt according to the present invention, obtained using a scanning electron microscope (SEM)

The area of the concavity is measured from a photograph obtained using a scanning electron microscope (SEM). FIG. 2 is a photograph of a surface of an intermediate transfer belt according to the present invention, obtained using a scanning electron microscope (SEM). Within a square field with each side having a length of 400 μm, the area of each of the concavities surrounded by the convexities is measured and averaged.

The size of the square field depends on the density and profile of the convexities. The square field preferably has a side having a length of from 200 to 600 μm. When the side is too short, the calculation of the average area of the concavities may be adversely affected by local unevenness of the convexities, if any, resulting in an unreliable calculated value. When the side is too long, it may take too long a time to measure each area of the concavities.

Next, exemplary embodiments of polyimide for use in the present invention are described.

An exemplary polyimide is obtained from a polyamic acid (i.e., a polyimide precursor) which is obtained from a reaction between an aromatic polycarboxylic anhydride or a derivative thereof and an aromatic diamine. Because polyimide is insoluble in solvents and non-meltable owing to its rigid structure of main-chain, the polyamic acid (i.e., a polyimide precursor), which is soluble in organic solvents, is previously subjected to various molding processes. The polyamic acid is then subjected to a dehydration reaction by heating or a chemical method so as to be cyclized (i.e., imidized). Thus, a polyimide is obtained. A typical reaction scheme (I) is described below.

(I)

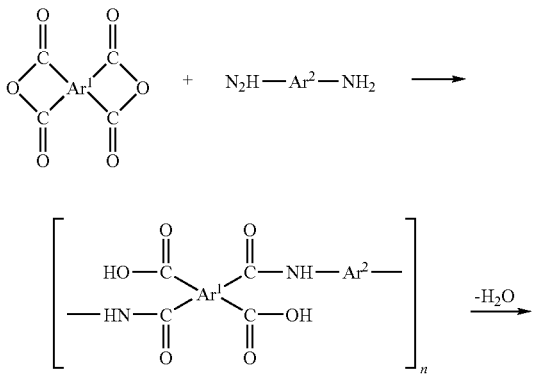

polyimide precursor

-continued

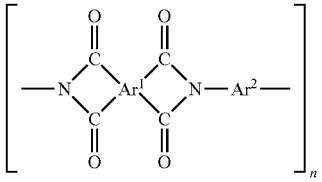

In the scheme (I), $Ar^1$ represents a tetravalent aromatic residue group including at least one six-membered carbon ring and $Ar^2$ represents a divalent aromatic residue group including at least one six-membered carbon ring.

Specific examples of usable aromatic polycarboxylic anhydrides include, but are not limited to, pyromellitic dianhydride, 3,3'-4,4'-benzophenone tetracarboxylic dianhydride, 2,2'-3,3'-benzophenone tetracarboxylic dianhydride, 3,3'-4,4'-biphenyl tetracarboxylic dianhydride, 2,2'-3,3'-biphenyl tetracarboxylic dianhydride, 2,2-bis(2,3-dicarboxyphenyl)propane dianhydride, bis(3,4-dicarboxyphenyl) ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2-bis(3,4-dicarboxyphenyl)-1,1,1,3,3,3-hexafluoropropane dianhydride, 2,3,6,7-naphthalene tetracarboxylic dianhydride, 1,4,5,8-naphthalene tetracarboxylic dianhydride, 1,2,5,6-naphthalene tetracarboxylic dianhydride, 1,2,3,4-benzenete tetracarboxylic dianhydride, 3,4,8,10-perylenete tetracarboxylic dianhydride, 2,3,6,7-anthracenete tetracarboxylic dianhydride, and 1,2,7,8-phenanthrene tetracarboxylic dianhydride. These compounds can be used alone or in combination. Additionally, other polycarboxylic anhydrides such as ethylene tetracarboxylic dianhydride and cyclopentane tetracarboxylic dianhydride can be used in combination in an amount less than 50% by mol.

Specific examples of usable aromatic diamines to be reacted with the aromatic polycarboxylic anhydrides include, but are not limited to, m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, bis(3-aminophenyl)sulfide, (3-aminophenyl)(4-aminophenyl) sulfide, bis(4-aminophenyl)sulfide,bis(3-aminophenyl) sulfide, (3-aminophenyl)(4-aminophenyl)sulfoxide, bis(3-aminophenyl)sulfone, (3-aminophenyl)(4-aminophenyl) sulfone, bis(4-aminophenyl)sulfone, 3,3'-diaminobenzophenone, 3,4'-diaminobenzophenone, 4,4'-diaminobenzophenone, 3,3'-diaminodiphenylmethane, 3,4'-diaminodiphenylmethane, 4,4'-diaminodiphenylmethane, bis[4-(3-aminophenoxy)phenyl]methane, bis[4-(4-aminophenoxy)phenyl]methane, 1,1-bis[4-(3-aminophenoxy) phenyl]ethane, 1,1-bis[4-(4-aminophenoxy)phenyl]ethane, 1,2-bis[4-(3-aminophenoxy)phenyl]ethane, 1,2-bis[4-(4-aminophenoxy)phenyl]ethane, 2,2-bis[4-(3-aminophenoxy) phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(3-aminophenoxy) biphenyl, 4,4'-bis(4-aminophenoxy)biphenyl, bis[4-(3-aminophenoxy)phenyl]ketone, bis[4-(4-aminophenoxy) phenyl]ketone, bis[4-(3-aminophenoxy)phenyl]sulfide, bis [4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α,α-dimethylbenzyl)phenoxy]benzophenone, 4,4'-bis[4-(4-amino-α,α-dimethylbenzyl)phenoxy]diphenyl sulfone, bis[4-{4-(4-aminophenoxy)phenoxy}phenyl]sulfone, 1,4-bis[4-(4-aminophenoxy)-α,α-dimethylbenzyl]benzene, and 1,3-bis[4-(4-aminophenoxy)-α,α-dimethylbenzyl]benzene. These compounds can be used alone or in combination.

A polyamic acid (i.e., a polyimide precursor) can be obtained from a polymerization reaction of a polycarboxylic anhydride with an approximately equimolar amount of a diamine in an organic polar solvent.

Specific examples of usable organic polar solvents for the polymerization reaction include, but are not limited to, sulfoxide solvents such as dimethyl sulfoxide and diethyl sulfoxide; formamide solvents such as N,N-dimethylformamide and N,N-diethylformamide; acetamide solvents such as N,N-dimethylacetamide and N,N-diethylacetamide; pyrrolidone solvents such as N-methyl-2-pyrrolidone and N-vinyl-2-pyrrolidone; phenol solvents such as phenol, o-cresol, m-cresol, p-cresol, xylenol, halogenated phenol, and catechol; ether solvents such as tetrahydrofuran, dioxane, and dioxolane; alcohol solvents such as methanol, ethanol, and butanol; cellosolves such as butyl cellosolve; hexamethylphosphoramide; and γ-butyrolactone. These solvents can be used alone or in combination. Among these solvents, N,N-dimethylacetamide and N-methyl-2-pyrrolidone are preferable.

An exemplary method of preparing a polyamic acid (i.e., a polyimide precursor) is described below. First, at least one kind of diamine is dissolved or dispersed in the organic polar solvent to prepare a solution or a slurry, respectively, under an inert gas atmosphere such as argon and nitrogen. Next, at least one kind of polycarboxylic anhydride or a derivative thereof, which may be either in a solid state or a solution/slurry state in the organic polar solvent, is added thereto to initiate a ring-opening polyaddition reaction. The ring-opening polyaddition reaction generates heat, thereby rapidly increasing the viscosity of the solution/slurry. Thus, a solution of a polyamic acid is prepared. The reaction temperature is preferably from −20 to 100° C., and more preferably 60° C. or less. The reaction time is preferably from about 30 minutes to 12 hours.

Alternatively, first, the polycarboxylic anhydride or a derivative thereof may be dissolved or dispersed in the organic polar solvent, and subsequently the diamine, which may be either in a solid state or a solution/slurry state in the organic polar solvent, may be added thereto. The mixing order of the polycarboxylic anhydride or a derivative thereof and the diamine is not limited. Of course, the polycarboxylic anhydride or a derivative thereof and the diamine can be added to the organic polar solvent simultaneously.

Consequently, a solution in which a polyamic acid (i.e., a polyimide precursor) is uniformly dissolved in the organic polar solvent is prepared from a polymerization reaction of the polycarboxylic anhydride or a derivative thereof with an equimolar amount of the diamine in the organic polar solvent.

In addition to the above-prepared solution of a polyamic acid (i.e., a polyimide precursor), commercially available polyimide varnishes in which a polyamic acid is dissolved in an organic solvent are also usable.

Specific examples of commercially available polyimide varnishes include, but are not limited to, TORAYNEECE (from Toray Industries, Inc.), U-Varnish (from Ube Industries, Ltd.), OPTMER (from JSR Corporation), SE812 (from Nissan Chemical Industries, Ltd.), and CRC8000 (from Sumitomo Bakelite Co., Ltd.).

Additionally, commercially available thermoplastic polyimide materials such as AURUM® (from Mitsui Chemicals, Inc.) and VESPEL® (from Du Pont) and solvent-soluble polyimide materials such as RIKACOAT (from New Japan Chemical Co., Ltd.), a block copolymerized polyimide Q-PILON® (from PI R & D Co., Ltd.), and GPI (from Gunei Chemical Industry Co., Ltd.) can be used in combination with the thermosetting polyimide materials as accessory components.

A polyamic acid solution, which may be either preparable from the reaction or commercially available, is then mixed with other components to prepare a coating liquid. The coating liquid is applied to a support (i.e., a mold) and heated so that the polyamic acid (i.e., a polyimide precursor) is transformed into a polyimide (i.e., imidized).

A polyamic acid can be transformed into a polyimide (i.e., imidized) by (1) heating or (2) a chemical method. An exemplary method of (1) includes heating a polyamic acid to 200 to 350° C., which is easy and practical. An exemplary method of (2) includes reacting a polyamic acid with a cyclodehydration reagent (e.g., a mixture of a carboxylic anhydride and a tertiary amine) and heating them. Because the method (2) is more complicated and costly, the method (1) is more practical.

Recently, another exemplary method of (2) has become practical in which an amine such as imidazole and quinoline is included in a varnish as a catalyst so that the imidization is accelerated at the time of drying. Generally, it is preferable that the imidization is completely terminated by heating the reaction system above the glass transition temperature of the resulting polyimide so that the polyimide may provide inherent abilities. The above-described method can accelerate the imidization at lower temperatures and can improve mechanical durability of the resulting polyimide. The amount of the catalyst is very small and the catalyst may be decomposed or sublimed at the time of drying.

The degree of imidization can be determined by a typical measuring method of imidization rate.

Specific exemplary methods of measuring imidization rate include, but are not limited to, a nuclear magnetic resonance spectroscopy (i.e., an NMR method) that calculates imidization rate from the integral ratio between $^1$H peak observed around 9 to 11 ppm that corresponds to amide group and $^1$H peak observed around 6 to 9 ppm that corresponds to aromatic ring; a Fourier transformation infrared spectroscopy (i.e., an FT-IR method); a method which determines quantity of moisture generated by ring-closing of imide; and a carboxylic acid neutralization titration method. Among these methods, a Fourier transformation infrared spectroscopy (i.e., an FT-IR method) is most practical.

For example, in a Fourier transformation infrared spectroscopy (i.e., an FT-IR method), the imidization rate is determined from the following equation:

$$\text{Imidization rate (\%)}=[(A)/(B)]\times 100$$

wherein (A) represents the number of moles of imide group at an imidization treatment stage (i.e., a calcination stage) and (B) represents the theoretical number of moles of imide group after complete imidization.

The number of moles of imide group is determined from absorbance ratio between characteristic absorptions of imide group which are measured by an FT-IR method. Representative absorbance ratios between characteristic absorptions for use in determination of the imidization rate are described below.

1) A ratio between an absorbance at 725 $cm^{-1}$ (corresponding to a scissoring vibration band of C═O group in imide ring) that is one of characteristic absorptions of imide and an absorbance at 1,015 $cm^{-1}$ that is a characteristic absorption of benzene ring.

2) A ratio between an absorbance at 1,380 $cm^{-1}$ (corresponding to a scissoring vibration band of C—N group in imide ring) that is one of characteristic absorptions of imide and an absorbance at 1,500 $cm^{-1}$ that is a characteristic absorption of benzene ring.

3) A ratio between an absorbance at 1,720 $cm^{-1}$ (corresponding to a scissoring vibration band of C═O group in imide ring) that is one of characteristic absorptions of imide and an absorbance at 1,500 $cm^{-1}$ that is a characteristic absorption of benzene ring.

4) A ratio between an absorbance at 1,720 $cm^{-1}$ that is one of characteristic absorptions of imide and an absorbance at 1,670 $cm^{-1}$ (corresponding to interaction between scissoring vibration of N—H group and stretching vibration of C—N group in amide group) that is a characteristic absorption of amide group.

Termination of imidization is reliably determined by disappearance of plural absorption bands at 3,000 to 3,300 $cm^{-1}$ corresponding to amide group.

The coating liquid may include another resin in combination with the polyimide, and various materials that give functions to the resulting intermediate transfer belt.

Specific examples of such materials include, but are not limited to, resistance controlling agents, reinforcement materials, leveling agents, surfactants, lubricants, antioxidants, and catalysts.

Among these materials, a resistance controlling agent is preferably added to the coating liquid so as to control the resulting intermediate transfer belt to a predetermined resistance.

Specific preferred materials for resistance controlling agents include, but are not limited to, fillers such as carbon black, graphite, metals (e.g., copper, tin, aluminum, indium), and metal oxides (e.g., tin oxide, zinc oxide, titanium oxide, indium oxide, antimony oxide, bismuth oxide, antimony-doped tin oxide, tin-doped indium oxide); conductive polymer materials such as polyether amide, polyether ester amide, polypyrrole, polythiophene, and polyaniline; and ion conductive materials such as tetraalkyl ammonium salt, trialkyl benzyl ammonium salt, alkyl sulfonate, alkylbenzene sulfonate, alkyl sulfate, glycerin fatty acid ester, sorbitan fatty acid ester, polyoxyethylene alkylamine, polyoxyethylene fatty alcohol ester, alkyl betaine, and lithium perchlorate. These materials can be used alone or in combination.

Among these materials, carbon black is preferable. Specific examples of usable carbon blacks include, but are not limited to, furnace black, acetylene black, ketjene black, and channel black. Surface-oxidized carbon blacks, the surface of which is oxidized, are also preferable.

Dispersing auxiliary agents may be used in combination with carbon blacks. Additionally, carbon blacks may be surface-treated by reacting a surface functional group with an organic compound reactive with the surface functional group.

An exemplary method of producing a seamless belt includes, for example, a dispersion preparing process in which a resistance controlling agent is dispersed in a solution of a polyimide precursor to prepare a dispersion; a coating liquid preparing process in which the content of the resistance controlling agent in the dispersion is adjusted to a predetermined value to prepare a coating liquid; a coating process in which the coating liquid is coated on a support (i.e., a mold); a solvent removal process in which the solvents are removed from the coating liquid which has been formed into a coated layer on the support by heating; an imidization process in which the polyimide precursor in the coated layer is subjected to imidization by heating; and releasing process in which the resulting thin film, i.e., a seamless belt is released from the support.

In the dispersion preparing process, the resistance controlling agent may be either directly dispersed in or mixed with the solution of a polyimide precursor or the resistance controlling agent is dispersed in a solvent first and subsequently the resulting dispersion is dispersed in or mixed with the solution of a polyimide precursor.

For example, a carbon black, which is one of the resistance controlling agents, can be dispersed as follows.

First, N-methyl-2-pyrrolidone is mixed with a carbon black and a small amount of a polyimide precursor. The mixture is subjected to a dispersion treatment for a predetermined time using a ball mill, a paint shaker, or a bead mill filled with zirconia beads to prepare a dispersion.

The dispersion is mixed with a solution of the polyimide precursor using a centrifugal mixer, a HENSCHEL MIXER, a homogenizer, or a sun-and-planet mixer, so as to control the concentration of the carbon black.

Additives such as a leveling agent and a catalyst can be added at that time of mixing, if needed.

The resulting mixture is preferably subjected to defoaming using a vacuum defoaming device.

The mold usable for centrifugal molding may be a metallic cylindrical support, the outer surface of which has concavities formed by sputtering. A release agent is applied to the mold and then the coating liquid containing a polyamic acid is applied thereon so that the resulting coated layer has a predetermined thickness. The coated layer is dried using a hot-air drier, an IH heater, or a far-infrared heater for 10 to 60 minutes at 80 to 120° C., and subsequently heated to 300 to 400° C. at a heating rate of from 2 to 5° C./min so as to initiate imidization.

The resulting intermediate transfer belt preferably has a thickness of from 50 to 100 μm. When the thickness is too small, strength and durability may be poor. When the thickness is too large, stiffness may be too large. It is generally difficult to reliably drive an intermediate transfer belt having a large stiffness with a driving roller having a small curvature.

The intermediate transfer belt preferably includes a carbon black as a resistance controlling agent in an amount of from 5 to 25% by weight so that the volume resistivity becomes 106 to 1,010 Ωcm. When the amount of carbon black is too small, it may be difficult to control resistance variation. When the amount of carbon black is too large, the intermediate transfer belt may be brittle and may have poor flexibility and durability. When the resistance is too low, toner particles may be scattered on non-image area when transferred onto the intermediate transfer belt, thereby decreasing image definition. When the resistance is too high, transfer electric field may not contribute to improve transfer efficiency.

Next, exemplary embodiments of lubricants used for the present invention are described in detail.

Specific examples of usable lubricants include, but are not limited to, metallic soaps having stearic acid group such as zinc stearate, barium stearate, iron stearate, nickel stearate, cobalt stearate, copper stearate, strontium stearate, and calcium stearate; metallic soaps having oleic acid group such as zinc oleate, barium oleate, lead oleate, iron oleate, nickel oleate, cobalt oleate, copper oleate, strontium oleate, and calcium oleate; metallic soaps having palmitic acid group such as zinc palmitate, barium palmitate, lead palmitate, iron palmitate, nickel palmitate, cobalt palmitate, copper palmitate, strontium palmitate, and calcium palmitate. These compounds are organic solid lubricants which have affinity for toner.

A mixture of zinc stearate and zinc palmitate is also preferable as the lubricant. Even when the linear speed of the intermediate transfer belt is high, such a mixture can be drawn thereon to completely cover the intermediate transfer belt.

Both zinc stearate and zinc palmitate are metallic salts of fatty acids. The fatty acid components, i.e., stearic acid and palmitic acid include 16 and 18 carbon atoms, respectively. Since zinc stearate and zinc palmitate have a similar structure, they are soluble with each other and function as substantially the same material. Both zinc stearate and zinc palmitate can protect the intermediate transfer belt.

When a specific amount of zinc palmitate is mixed with zinc stearate, the resulting mixture is easily drawn on the intermediate transfer belt because zinc palmitate has a lower melting point than zinc stearate. Therefore, such a mixture can completely cover the intermediate transfer belt even when the linear speed of the intermediate transfer belt is high.

As the linear speed of an image bearing member (e.g., a photoreceptor) increases, the intermediate transfer belt receives more charging energy, especially AC charging energy. In this case, the intermediate transfer belt needs to improve protection effect by increasing the thickness of lubricant applied thereon.

Rather than each single molecule of zinc stearate randomly adheres on the intermediate transfer belt, it is likely that each pair of molecules adheres on the intermediate transfer belt. The latter is in more reliable state than the former. Accordingly, the saturated thickness of a molecular layer of zinc stearate is equal to the thickness of its bimolecular layer. In a case in which a specific amount of zinc palmitate is immixed in the zinc stearate, the thickness of the resulting molecular layer varies by location because zinc palmitate has a shorter molecular length than zinc stearate. In this case, molecules are likely to accumulate on lower portions, thereby consequently forming a thicker layer having better protection effect than the bimolecular layer. If the immixed amount of zinc palmitate is too large, the bimolecular layer of zinc palmitate is likely to be formed, which is thinner and provides poorer protection effect than the bimolecular layer of zinc stearate.

Accordingly, an exemplary embodiment of the lubricant includes a mixture of zinc stearate and zinc palmitate. The weight ratio of the zinc stearate to the zinc palmitate is preferably from 75/25 to 40/60, and more preferably from 70/30 to 45/55. Within the above range, the lubricant forms a thick layer which can entirely protect the intermediate transfer belt even when the linear speed of the intermediate transfer belt is high.

Another exemplary embodiment of the lubricant includes a mixture of zinc stearate, zinc palmitate, and another metallic soap. Specific preferred examples of metallic soaps to be mixed with zinc stearate and zinc palmitate include, but are not limited to, metallic soaps having a similar structure to zinc stearate and zinc palmitate, such as zinc soaps of fatty acids having 13 to 20 carbon atoms.

The lubricant may be in the form of powder to be directly supplied onto the intermediate transfer belt. Alternatively, the lubricant may be in the form of block. In this case, a brush or the like is pressed against the block so that the brush scrapes off the block and the powdered lubricant is supplied onto the intermediate transfer belt. The latter is more preferable because block-like lubricants are easy to store, a lubricant applicator has a simple structure, and lubricants are uniformly supplied.

An exemplary method of forming a block of a lubricant includes, for example, melting a lubricant, pouring the melted lubricant into a mold, and cooling.

The resulting block of lubricant may be adhered to a support made of a metal, a metal alloy, or a plastic with an adhesive.

It is preferable to measure the ratio between zinc stearate and zinc palmitate in every manufacturing lot of lubricant block because raw materials often include impurities. The ratio between zinc stearate and zinc palmitate in a lubricant block can be measured as follows, for example. First, a lubricant block is dissolved in a hydrochloric acid-methanol solution and heated to 80° C. so that stearic acid and palmitic acid are methylated. Next, the ratio between stearic acid and palmitic acid is measured by a gas chromatography and is converted into the ratio between zinc stearate and zinc palmitate.

Next, exemplary embodiments of an image forming apparatus according to the present invention are described in detail below.

Figure 3:
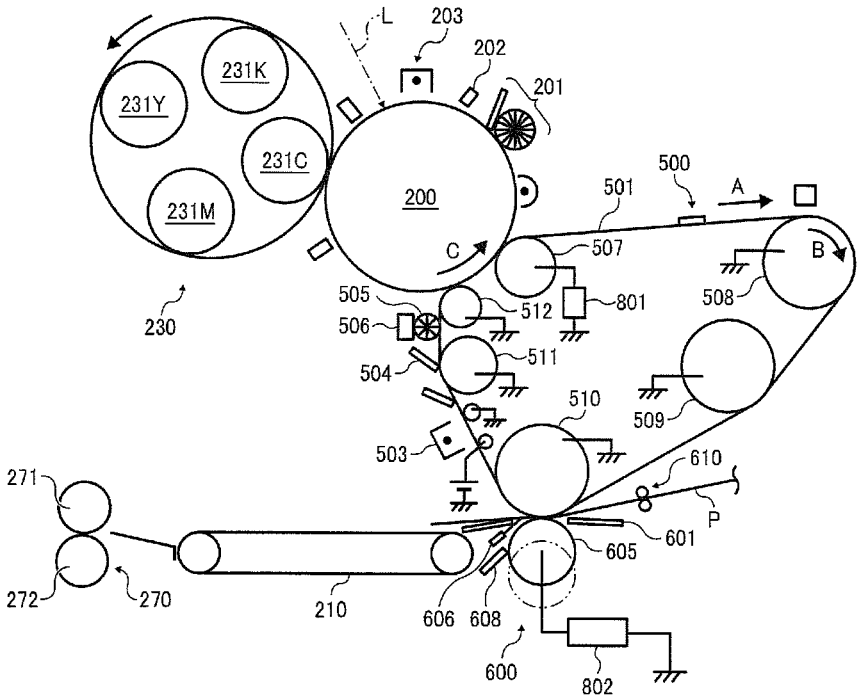
FIG. 3 is a schematic view illustrating an embodiment of an image forming apparatus equipped with an intermediate transfer belt according to the present invention.

FIG. 3 is a schematic view illustrating an embodiment of an image forming apparatus equipped with an intermediate transfer belt according to the present invention.

An intermediate transfer unit 500 includes an intermediate transfer belt 501 stretched taut with plural rollers. A secondary transfer bias roller 605, a belt cleaning blade 504, and a lubricant application brush 505 are provided facing the intermediate transfer belt 501. The secondary transfer bias roller 605 is included in a secondary transfer unit 600 and serves as a secondary transfer charger. The belt cleaning blade 504 serves as an intermediate transfer belt cleaner. The lubricant application brush 505 serves as a lubricant applicator.

The intermediate transfer belt 501 is stretched taut with a primary transfer bias roller 507, a belt driving roller 508, a belt tension roller 509, a secondary transfer facing roller 510, a cleaning facing roller 511, and a feedback current detection roller 512. The primary transfer bias roller 507 serves as a primary transfer charger. Each of the rollers is made of a conductive material. Each of the rollers other than the primary transfer bias roller 507 is grounded. A transfer bias is applied to the primary transfer bias roller 507 from a primary transfer power source 801 that is constant-current-controlled or constant-voltage-controlled. The transfer bias includes a current or voltage controlled to a predetermined value based on the number of toner images which are superimposed on one another.

The intermediate transfer belt 501 is driven to rotate in a direction indicated by an arrow A by the belt driving roller 508 that is driven to rotate in a direction indicated by an arrow B by a driving motor, not shown. Preferred embodiments of the intermediate transfer belt 501 include a semiconductor and an insulator with a single-layer or multi-layer structure. The most preferred embodiment of the intermediate transfer belt 501 is the above-described intermediate transfer belt of the present invention which provides improved durability and high quality images. The size of the intermediate transfer belt 501 is large enough to superimpose toner images formed on a photoreceptor 200 serving as an image bearing member.

The secondary transfer bias roller 605 can arbitrarily contact and separate from a portion of an outer surface of the intermediate transfer belt 501 which is stretched taut with the secondary transfer facing roller 510. A transfer paper P is sandwiched between the secondary transfer bias roller 605 and the intermediate transfer belt 501 at the portion in which the intermediate transfer belt 510 is stretched taut with the secondary transfer facing roller 510. A transfer bias including a predetermined current is applied to the secondary transfer bias roller 605 from a secondary transfer power source 802 that is constant-current-controlled.

A registration roller 610 conveys the transfer paper P to between the secondary transfer bias roller 605 and the portion of the outer surface of the intermediate transfer belt 501 which is stretched taut with the secondary transfer facing roller 510 in synchronization with an entry of a toner image thereto. A cleaning blade 608 is in contact with the secondary transfer bias roller 605. The cleaning blade 608 is configured to remove substances adhered to a surface of the secondary transfer bias roller 605.

Once an image forming operation starts, the photoreceptor 200 is driven to rotate in a direction indicated by an arrow C by a driving motor, not shown. The photoreceptor 200 is then charged by a charger 203 and is exposed to a light beam L emitted from an irradiator based on color image information so that black, cyan, magenta, and yellow toner images are sequentially formed thereon. The intermediate transfer belt 501 is driven to rotate in a direction indicated by an arrow A by the belt driving roller 508. The black, cyan, magenta, and yellow toner images are sequentially transferred from the photoreceptor 200 onto the intermediate transfer belt 501 by the transfer bias applied to the primary transfer bias roller 507 along with the rotation of the intermediate transfer belt 501. (This process is hereinafter referred to as "primary transfer process".) Finally, the black, cyan, magenta, and yellow toner images are superimposed on one another in this order on the intermediate transfer belt 501.

More specifically, for example, the black toner image is formed as follows. The charger 203 negatively and uniformly charges a surface of the photoreceptor 200 to a predetermined potential by corona discharge. An optical unit, not shown, directs a laser light beam L to the charged surface of the photoreceptor 200 based on a black image signal. As a result, a black electrostatic latent image is formed on a portion of the photoreceptor 200 which has been exposed to the laser light beam because charges disappear in an amount proportional to the amount of exposure light. A negatively-charged black toner on a developing roller in a black developing device 231 contacts the photoreceptor 200. The black toner does not adhere to a portion on which charges remain but adheres to the portion which has been exposed to the laser light beam, i.e., on which no charge remain. Thus, a black toner image is formed on the photoreceptor 200.

The black toner image is transferred from the photoreceptor 200 onto an outer surface of the intermediate transfer belt 501 that is driven to rotate at a constant speed while contacting the photoreceptor 200 (i.e., the primary transfer process). A slight amount of residual toner particles remaining on the photoreceptor 200 without being transferred onto the intermediate transfer belt 501 is removed by a photoreceptor cleaning device 201 so that the photoreceptor 200 can prepare for a next image formation. On the other hand, a scanner starts to read yellow image data. The photoreceptor 200 is exposed to a laser light beam based on the yellow image data so that a yellow electrostatic latent image is formed thereon.

A revolver developing unit 230 rotates after a rear end of the black electrostatic latent image has passed a developing position and a front end of the yellow electrostatic latent image reaches the developing position so that a yellow developing device 231Y comes to the developing position and develops the yellow electrostatic latent image with a yellow toner. Similarly, after a rear end of the yellow electrostatic latent image has passed the developing position and a front end of a cyan electrostatic latent image reaches the developing position, the revolver developing unit 230 rotates so that a cyan developing device 231C comes to the developing position. Cyan and magenta toner images are formed in a similar manner as the black and yellow toner images.

The black, yellow, cyan, magenta toner images are sequentially formed on the photoreceptor 200 and sequentially transferred onto the same surface of the intermediate transfer belt 501 while adjusting the positions (i.e., the primary transfer process). Thus, a composite toner image (hereinafter simply "toner image") in which the black, yellow, cyan, magenta toner images are superimposed on one another is formed on the intermediate transfer belt 501. On the other hand, the transfer paper P is fed from a transfer paper cassette or a manual paper feed tray to a nip of the registration roller 610 in synchronization with a start of the image forming operation.

A secondary transfer area is formed between the secondary transfer bias roller 605 and the portion of the intermediate transfer belt 501 which is stretched taut with the secondary transfer facing roller 510. The transfer paper P is fed to the secondary transfer area along a guide plate 601 by rotation of the registration roller 610 in synchronization with an entry of a front end of the toner image on the intermediate transfer belt 501 to the secondary transfer area, so that a front end of the transfer paper P and the front end of the toner image are coincident.

The transfer paper P is conveyed along the guide plate 601 and is neutralized when passing by a transfer paper neutralization charger 606 including a neutralization needle provided downstream from the secondary transfer area. The transfer paper P is further conveyed by a belt conveyer 210 to a fixing device 270. The toner image is melted and fixed on the transfer paper P at a nip formed between a fixing roller 271 and a pressing roller 272 in the fixing device 270. The transfer paper P on which the toner image is fixed is discharged from the image forming apparatus by a discharge roller, not shown, and is stacked on a copy tray, not shown, face up. Of course, the fixing device 270 may include a fixing belt in place of the fixing roller 271.

After transferring the toner images, the surface of the photoreceptor 200 is cleaned by the photoreceptor cleaning device 201 and is uniformly neutralized by a neutralization lamp 202. Residual toner particles remaining on an outer surface of the intermediate transfer belt 501 without being transferred onto the transfer paper P are removed by the belt cleaning blade 504. The cleaning blade 504 is brought into contact with and is separated from the outer surface of the intermediate transfer belt 501 at a predetermined timing by a cleaning member contact/separate mechanism, not shown.

A toner sealing member 503 is provided upstream from the belt cleaning blade 504 relative to the direction of movement of the intermediate transfer belt 501. The toner sealing member 503 is configured to receive fallen toner particles while the belt cleaning blade 504 removes residual toner particles from the intermediate transfer belt 501, thereby preventing the fallen toner particles from scattering around conveyance paths of the transfer paper P. The toner sealing member 503 is brought into contact with and is separated from the outer surface of the intermediate transfer belt 501 at a predetermined timing by a cleaning member contact/separate mechanism, not shown, along with the belt cleaning blade 504.

The lubricant application brush 505 scrapes off a lubricant 506 and applies the powdered lubricant to an outer surface of the intermediate transfer belt 501 from which residual toner particles have been removed. The lubricant application brush 505 is provided in contact with the lubricant 506. Residual charges remaining on an outer surface of the intermediate transfer belt 501 are removed by applying a neutralization bias from a belt neutralization brush, not shown, that is in contact with the outer surface of the intermediate transfer belt 501. Each of the lubricant application brush 505 and the belt neutralization brush is brought into contact with and is separated from the outer surface of the intermediate transfer belt 501 at a predetermined timing by a contact/separate mechanism, not shown.

When the copying operation is performed repeatedly, the image forming operation of the first color, i.e., black, starts again at a termination of the image forming operation of the fourth color, i.e., magenta. After transferring the composite toner image from the intermediate transfer belt 501 onto the first sheet, the inter mediate transfer belt 501 is cleaned by the belt cleaning blade 504 and subsequently a black toner image to be formed on the second sheet is transferred from the photoreceptor 200 onto the intermediate transfer belt 501. The succeeding processes are the same as those in the copying operation of the first sheet.

The above-described copying operation is for producing four-color copies. When producing three-color or two-color copies, the repeated number of the copying operation is changed according to the number of the designated colors. When producing one-color copies, only the developing device corresponding to the designated color is brought into operation while bringing the belt cleaning blade 504 into contact with the intermediate transfer belt 501.

Figure 4:
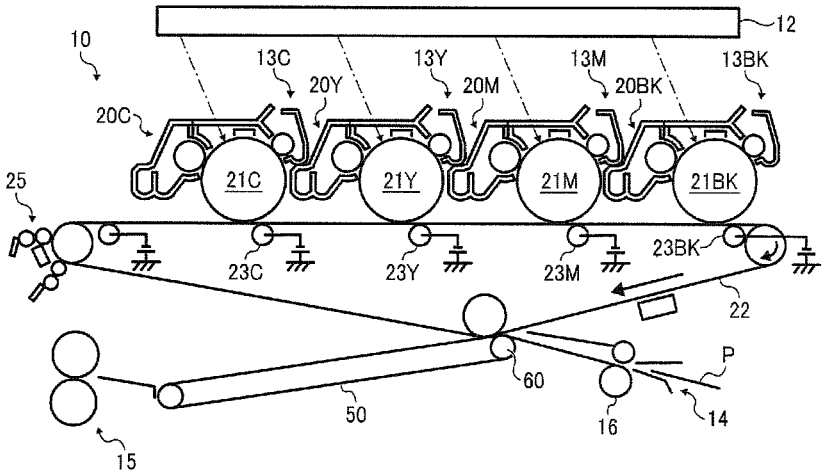
FIG. 4 is a schematic view illustrating another embodiment of an image forming apparatus in which plural photoreceptors are arranged in tandem along an intermediate transfer belt according to the present invention.

FIG. 4 is a schematic view illustrating another embodiment of an image forming apparatus in which plural photoreceptors are arranged in tandem along an intermediate transfer belt according to the present invention.

An image forming apparatus illustrated in FIG. 4 is a digital color printer 10 including four photoreceptors 21BK, 21M, 21Y, and 21C for forming black, magenta, yellow, and cyan toner images, respectively, serving as image bearing members.

The printer 10 includes an image writing part 12, a black image forming part 13BK, a magenta image forming part 13M, a yellow image forming part 13Y, a cyan image forming part 13C, and a paper feeding part 14. Black, magenta, yellow, and cyan image information are converted into black, magenta, yellow, and cyan image signals in an image processing part, not shown, and the image signals are transmitted to the image writing part 12. The image writing part 12 may be, for example, a laser scanning optical system including a laser light source, a deflector such as a rotary polygon mirror, a scanning imaging optical system, and mirrors. The image writing part 12 includes four writing optical paths each corresponding to the black, magenta, yellow, and cyan image signals for writing images on the photoreceptors 21BK, 21M, 21Y, and 21C, respectively.

The black image forming part 13BK, the magenta image forming part 13M, the yellow image forming part 13Y, and the cyan image forming part 13C include the photoreceptors 21BK, 21M, 21Y, and 21C, respectively, serving as image bearing members. Preferred embodiment of the image bearing member is an organic photoconductor. Around each of the photoreceptors 21BK, 21M, 21Y, and 21C, a respective charger, a respective irradiator for directing laser light beam to the photoreceptor from the image writing part 12, a developing device 20BK, 20M, 20Y, or 20C, a primary transfer bias roller 23BK, 23M, 23Y, or 23C, a respective cleaning device, not shown, and a respective neutralization device, not shown, are provided. The developing devices 20BK, 20M, 20Y, and 20C employ a two-component magnetic brush developing method. An intermediate transfer belt 22 is provided between a set of the photoreceptors 21BK, 21M, 21Y, and 21C and a set of the primary transfer bias rollers 23BK, 23M, 23Y, and 23C so that toner images formed on each photoreceptors are sequentially transferred and superimposed thereon to form a composite toner image.

On the other hand, a transfer paper P is fed from the paper feeding part 14 onto a transfer conveyance belt 50 through a registration roller 16. A secondary transfer bias roller 60 transfers the composite toner image from the intermediate transfer belt 22 onto the transfer paper P at a contact point of the intermediate transfer belt 22 with the transfer conveyance belt 50. The transfer paper P having the composite toner image thereon is conveyed to a fixing device 15 and the composite toner image is fixed on the transfer paper P in the fixing device 15. The transfer paper P on which the composite toner image is fixed is discharged from the printer 10.

Residual toner particles remaining on the intermediate transfer belt 22 without being transferred onto the transfer paper P are removed by a belt cleaning device 25. A lubricant applicator, not shown, is provided downstream from the belt cleaning device 25. The lubricant applicator includes a solid lubricant and a conductive brush for scraping the lubricant and applying the lubricant to the intermediate transfer belt 22. The conductive brush is in contact with the intermediate transfer belt 22 so that the lubricant is constantly applied thereto.

The above-described embodiments of the intermediate transfer belt of the present invention are preferably usable for the intermediate transfer belt 501 or 22. Additionally, the embodiments of the intermediate transfer belt of the present invention are also preferably usable for the belt conveyer 210 or the transfer conveyance belt 50.

The intermediate transfer belt of the present invention is usable at both low and high linear speeds. When the linear speed is 200 mm/sec or more, the intermediate transfer belt shows prominent effects. When the linear speed is 400 mm/sec or more, conventional intermediate transfer belts may cause uneven application of lubricant.

The intermediate transfer belt of the present invention is usable even when the linear speed is 400 mm/sec or more, but preferably used at a linear speed of less than 600 mm/sec.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Intermediate Transfer Belt A

To prepare a carbon black dispersion, 2 parts of a polyimide solution U-Varnish A (including 18% of solid components, from Ube Industries, Ltd.), 8 parts of a carbon black Special Black 4A (from Degussa), and 90 parts of N-methyl-2-pyrrolidone (from Mitsubishi Chemical Corporation) are mixed and the mixture is subjected to a dispersion treatment for 5 hours using a bead mill disperser filled with zirconia beads with a diameter of 1 mm.

To prepare a coating liquid, 50 parts of the carbon black dispersion, 50 parts of a polyimide solution U-Varnish A (including 18% of solid components, from Ube Industries, Ltd.), and 0.01 parts of a polyether-modified silicone FZ2105 (from Dow Corning Toray Co., Ltd.) are mixed and the mixture is subjected to defoaming using a centrifugal agitation defoaming device.

The coating liquid is poured into a metallic cylindrical mold having an outer diameter of 100 mm and a length of 300 mm which has been treated with a lubricant while rotating the metallic cylindrical mold at a revolution of 50 rpm, so that an inner surface thereof is uniformly applied with the coating liquid. The inner surface of the metallic cylindrical mold have linear concavities with a depth of 0.01 μm and a width of 1 μm, which are formed by sputtering so that the average area surrounded with the linear concavities is 1,000 $\mu m^2$. The applied amount of the coating liquid is controlled so that the resulting layer has a thickness of 70 μm. At the completion of application of the coating liquid, the metallic cylindrical mold is put in a hot-air circular drier while rotating and is heated to 100° C. at a heating rate of 3° C./min. The metallic cylindrical mold is kept heated at 100° C. for 30 minutes. The metallic cylindrical mold is then put in a heating furnace (a baking furnace) capable of performing high-temperature treatments while stopping rotation and is heated to 310° C. at a heating rate of 2° C./min. The metallic cylindrical mold is kept heated at 310° C. for 60 minutes to be calcined, followed by cooling to room temperature.

Thus, an intermediate transfer belt A is prepared. The surface of the intermediate transfer belt A has linear convexities with a height of 0.01 μm and a width of 1 μm. The average area surrounded with the linear convexities is 1,000 $\mu m^2$.

(Preparation of Lubricant A)

First, 45 parts of zinc stearate and 55 parts of zinc palmitate (having a primary particle diameter of 0.18 μm) are weighed and mixed. The mixture is heated to 145° C. and the melted mixture is poured into a mold, followed by cooling. Thus, a lubricant block with each side having a length of 40 mm, 8 mm, and 350 mm is prepared. The lubricant block is adhered to a support with an adhesive to prepare a lubricant A.

Example 2

Preparation of Intermediate Transfer Belt B

The procedure for preparation of the intermediate transfer belt A is repeated except for changing the profile of the convexities on the surface. Specifically, the mold is changed to another mold, the inner surface of which has linear concavities with a depth of 0.02 μm and a width of 1 μm, which are formed so that the average area surrounded with the linear concavities is 1,000 $\mu m^2$.

Thus, an intermediate transfer belt B is prepared. The surface of the intermediate transfer belt B has linear convexities with a height of 0.02 μm and a width of 1 μm. The average area surrounded with the linear convexities is 1,000 $\mu m^2$.

In the evaluations, the lubricant A is used.

Example 3

Preparation of Intermediate Transfer Belt C

The procedure for preparation of the intermediate transfer belt A is repeated except for changing the profile of the convexities on the surface. Specifically, the mold is changed to another mold, the inner surface of which has linear concavities with a depth of 0.1 μm and a width of 1 μm, which are formed so that an area surrounded with the linear concavities is 1,000 $\mu m^2$.

Thus, an intermediate transfer belt C is prepared. The surface of the intermediate transfer belt C has linear convexities with a height of 0.1 μm and a width of 1 μm. The average area surrounded with the linear convexities is 1,000 $\mu m^2$.

In the evaluations, the lubricant A is used.

Example 4

Preparation of Intermediate Transfer Belt D

The procedure for preparation of the intermediate transfer belt A is repeated except for changing the profile of the convexities on the surface. Specifically, the mold is changed to another mold, the inner surface of which has linear concavities with a depth of 1 μm and a width of 1 μm, which are formed so that an area surrounded with the linear concavities is 1,000 $\mu m^2$.

Thus, an intermediate transfer belt D is prepared. The surface of the intermediate transfer belt D has linear convexities with a height of 1 μm and a width of 1 μm. The average area surrounded with the linear convexities is 1,000 $\mu m^2$.

In the evaluations, the lubricant A is used.

Example 5

Preparation of Intermediate Transfer Belt E

The procedure for preparation of the intermediate transfer belt A is repeated except for changing the profile of the convexities on the surface. Specifically, the mold is changed to another mold, the inner surface of which has linear concavities with a depth of 0.1 μm and a width of 0.5 μm, which are formed so that an area surrounded with the linear concavities is 1,000 $\mu m^2$.

Thus, an intermediate transfer belt E is prepared. The surface of the intermediate transfer belt E has linear convexities with a height of 0.1 μm and a width of 0.5 μm. The average area surrounded with the linear convexities is 1,000 $\mu m^2$.

In the evaluations, the lubricant A is used.

Example 6

Preparation of Intermediate Transfer Belt F

The procedure for preparation of the intermediate transfer belt A is repeated except for changing the profile of the convexities on the surface. Specifically, the mold is changed to another mold, the inner surface of which has linear concavities with a depth of 0.1 μm and a width of 2 μm, which are formed so that an area surrounded with the linear concavities is 1,000 $\mu m^2$.

Thus, an intermediate transfer belt F is prepared. The surface of the intermediate transfer belt F has linear convexities with a height of 0.1 μm and a width of 2 μm. The average area surrounded with the linear convexities is 1,000 $\mu m^2$.

In the evaluations, the lubricant A is used.

Example 7

Preparation of Intermediate Transfer Belt G

The procedure for preparation of the intermediate transfer belt A is repeated except for changing the profile of the convexities on the surface. Specifically, the mold is changed to another mold, the inner surface of which has linear concavities with a depth of 0.1 μm and a width of 5 μm, which are formed so that an area surrounded with the linear concavities is 1,000 $\mu m^2$.

Thus, an intermediate transfer belt G is prepared. The surface of the intermediate transfer belt G has linear convexities with a height of 0.1 μm and a width of 5 μm. The average area surrounded with the linear convexities is 1,000 $\mu m^2$.

In the evaluations, the lubricant A is used.

Example 8

Preparation of Intermediate Transfer Belt H

The procedure for preparation of the intermediate transfer belt A is repeated except for changing the profile of the convexities on the surface. Specifically, the mold is changed to another mold, the inner surface of which has linear concavities with a depth of 0.1 μm and a width of 1 μm, which are formed so that an area surrounded with the linear concavities is 3,000 $\mu m^2$.

Thus, an intermediate transfer belt H is prepared. The surface of the intermediate transfer belt H has linear convexities with a height of 0.1 μm and a width of 1 μm. The average area surrounded with the linear convexities is 3,000 $\mu m^2$.

In the evaluations, the lubricant A is used.

Example 9

Preparation of Intermediate Transfer Belt I

The procedure for preparation of the intermediate transfer belt A is repeated except for changing the profile of the convexities on the surface. Specifically, the mold is changed to another mold, the inner surface of which has linear concavities with a depth of 0.1 μm and a width of 1 μm, which are formed so that an area surrounded with the linear concavities is 15,000 $\mu m^2$.

Thus, an intermediate transfer belt I is prepared. The surface of the intermediate transfer belt I has linear convexities with a height of 0.1 μm and a width of 1 μm. The average area surrounded with the linear convexities is 15,000 $\mu m^2$.

In the evaluations, the lubricant A is used.

Example 10

Preparation of Intermediate Transfer Belt J

The procedure for preparation of the intermediate transfer belt A is repeated except for changing the profile of the convexities on the surface. Specifically, the mold is changed to another mold, the inner surface of which has linear concavities with a depth of 0.1 μm and a width of 1 μm, which are formed so that an area surrounded with the linear concavities is 30,000 $\mu m^2$.

Thus, an intermediate transfer belt J is prepared. The surface of the intermediate transfer belt J has linear convexities with a height of 0.1 μm and a width of 1 μm. The average area surrounded with the linear convexities is 30,000 $\mu m^2$.

In the evaluations, the lubricant A is used.

Example 11

Preparation of Lubricant B

The procedure for preparation of the lubricant A is repeated except for changing the amounts of zinc stearate and palmitic stearate to 75 parts and 25 parts, respectively. Thus, a lubricant B is prepared.

In the evaluations, the intermediate transfer belt C is used.

Example 12

Preparation of Lubricant C

The procedure for preparation of the lubricant A is repeated except for changing the amounts of zinc stearate and palmitic stearate to 70 parts and 30 parts, respectively. Thus, a lubricant C is prepared.

In the evaluations, the intermediate transfer belt C is used.

Example 13

Preparation of Lubricant D

The procedure for preparation of the lubricant A is repeated except for changing the amounts of zinc stearate and palmitic stearate to 40 parts and 60 parts, respectively. Thus, a lubricant D is prepared.

In the evaluations, the intermediate transfer belt C is used.

Example 14

Preparation of Intermediate Transfer Belt K

The procedure for preparation of the intermediate transfer belt A is repeated except for changing the profile of the convexities on the surface. Specifically, the mold is changed to another mold, the inner surface of which has linear concavities with a depth of 0.05 μm and a width of 1.5 μm, which are formed so that an area surrounded with the linear concavities is 900 $\mu m^2$.

Thus, an intermediate transfer belt K is prepared. The surface of the intermediate transfer belt K has linear convexities with a height of 0.05 μm and a width of 1.5 μm. The average area surrounded with the linear convexities is 900 $\mu m^2$.

In the evaluations, the lubricant A is used.

Example 15

Preparation of Intermediate Transfer Belt L

The procedure for preparation of the intermediate transfer belt A is repeated except for changing the profile of the convexities on the surface. Specifically, the mold is changed to another mold, the inner surface of which has linear concavities with a depth of 0.05 μm and a width of 1.5 μm, which are formed so that an area surrounded with the linear concavities is 35,000 $\mu m^2$.

Thus, an intermediate transfer belt L is prepared. The surface of the intermediate transfer belt L has linear convexities with a height of 0.05 μm and a width of 1.5 μm. The average area surrounded with the linear convexities is 35,000 $\mu m^2$.

In the evaluations, the lubricant A is used.

Example 16

Preparation of Intermediate Transfer Belt M

The procedure for preparation of the intermediate transfer belt A is repeated except for changing the profile of the convexities on the surface. Specifically, the mold is changed to another mold, the inner surface of which has linear concavities with a depth of 0.05 μm and a width of 1.5 μm, which are formed so that an area surrounded with the linear concavities is 1,000 $\mu m^2$.

Thus, an intermediate transfer belt M is prepared. The surface of the intermediate transfer belt M has linear convexities with a height of 0.05 μm and a width of 1.5 μm. The average area surrounded with the linear convexities is 1,000 $\mu m^2$.

(Preparation of Lubricant E)

Zinc stearate (having a primary particle diameter of 0.18 μm) is heated to 145° C. and the melted zinc stearate is poured into a mold, followed by cooling. Thus, a lubricant block with each side having a length of 40 mm, 8 mm, and 350 mm is prepared. The lubricant block is adhered to a support with an adhesive to prepare a lubricant E.

Comparative Example 1

Preparation of Intermediate Transfer Belt N

The procedure for preparation of the intermediate transfer belt A is repeated except for changing the profile of the convexities on the surface. Specifically, the mold is changed to another mold, the inner surface of which has linear concavities with a depth of 0.005 μm and a width of 1 μm, which are formed so that an area surrounded with the linear concavities is 1,000 $\mu m^2$.

Thus, an intermediate transfer belt N is prepared. The surface of the intermediate transfer belt N has linear convexities with a height of 0.005 μm and a width of 1 μm. The average area surrounded with the linear convexities is 1,000 $\mu m^2$.

In the evaluations, the lubricant A is used.

Comparative Example 2

Preparation of Intermediate Transfer Belt O

The procedure for preparation of the intermediate transfer belt A is repeated except for changing the profile of the convexities on the surface. Specifically, the mold is changed to another mold, the inner surface of which has linear concavities with a depth of 1.5 μm and a width of 1 μm, which are formed so that an area surrounded with the linear concavities is 1,000 $\mu m^2$.

Thus, an intermediate transfer belt O is prepared. The surface of the intermediate transfer belt O has linear convexities with a height of 1.5 μm and a width of 1 μm. The average area surrounded with the linear convexities is 1,000 $\mu m^2$.

In the evaluations, the lubricant A is used.

Comparative Example 3

Preparation of Intermediate Transfer Belt P

The procedure for preparation of the intermediate transfer belt A is repeated except for changing the profile of the convexities on the surface. Specifically, the mold is changed to another mold, the inner surface of which has linear concavities with a depth of 0.1 μm and a width of 0.4 μm, which are formed so that an area surrounded with the linear concavities is 1,000 $\mu m^2$.

Thus, an intermediate transfer belt P is prepared. The surface of the intermediate transfer belt P has linear convexities with a height of 0.1 μm and a width of 0.4 μm. The average area surrounded with the linear convexities is 1,000 $\mu m^2$.

In the evaluations, the lubricant A is used.

Comparative Example 4

Preparation of Intermediate Transfer Belt Q

The procedure for preparation of the intermediate transfer belt A is repeated except for changing the profile of the convexities on the surface. Specifically, the mold is changed to another mold, the inner surface of which has linear concavities with a depth of 0.1 μm and a width of 6 μm, which are formed so that an area surrounded with the linear concavities is 1,000 $\mu m^2$.

Thus, an intermediate transfer belt Q is prepared. The surface of the intermediate transfer belt Q has linear convexities with a height of 0.1 μm and a width of 6 μm. The average area surrounded with the linear convexities is 1,000 $\mu m^2$.

In the evaluations, the lubricant A is used.

Evaluations

Each combination of an intermediate transfer belt and a lubricant prepared in Examples 1 to 16 and Comparative Examples 1 to 4 is mounted on the image forming apparatus illustrated in FIG. 4. An image having an image area ratio of 7% is produced on 5 sheets of a paper TYPE 6200 (from Ricoh Co., Ltd.) at 23° C. and 45% RH. The linear speed of the image forming operation is 250 mm/sec.

As a result, Examples 1 to 16 and Comparative Examples 1 and 4 do not produce abnormal image. Comparative Example 2 produces an abnormal image with undesired lines on the first sheet and later. Comparative Example 3 produces an abnormal image with defects on the first sheet and later.

With regard to Examples 1 to 16 and Comparative Examples 1 and 4, the linear speed of the image forming operation is increased to 450 mm/sec, and an image having an image area ratio of 7% is produced on 5 sheets/job of a paper TYPE 6200 (from Ricoh Co., Ltd.) at 23° C. and 45% RH again. The image is eventually produced on 30,000 sheets of the paper in total. Subsequently, halftone images of yellow, cyan, magenta, and black are produced and subjected to image evaluation.

As a result, in Comparative Example 1, undesired lines are slightly produced on the black halftone image. In Comparative Example 4, dots are blurred in the cyan, magenta, and black halftone images when observed with a magnifying glass, which is apparently beyond the allowable level.

With regard to Examples 1 to 16, an image having an image area ratio of 7% is produced on 5 sheets/job of a paper TYPE 6200 (from Ricoh Co., Ltd.) at 17° C. and 10% RH again while the linear speed of the image forming operation is 450 mm/sec. The image is eventually produced on 20,000 sheets of the paper in total. Subsequently, halftone images of yellow, cyan, magenta, and black are produced and subjected to image evaluation.

As a result, in Examples 14, 15, and 16, dots are blurred in all the halftone images when observed with a magnifying glass. However, the degree of the blurring is within the allowable level for practical use. In Examples 1, 4, 5, 7, 8, 10, 11, and 13, dots are slightly blurred in the cyan, magenta, and black halftone images when observed with a magnifying glass. However, all the halftone images have high quality. In Examples 2, 3, 6, 9, and 12, blurring of dots is not observed and all the halftone images have very high quality.

The evaluation results are shown in Table 1. The overall evaluation results are graded into the following 4 grades.

A: Very high quality image is produced at 17° C., 10% RH, and 450 mm/sec.

B: High quality image is produced at 17° C., 10% RH, and 450 mm/sec.

C: Allowable image is produced at 17° C., 10% RH, and 450 mm/sec. (Dot blurring is observed with a magnifying glass.)

D: Abnormal image is produced at 23° C., 45% RH, and 450 mm/sec.

E: Abnormal image is produced at 23° C., 45% RH, and 250 mm/sec.

TABLE 1

| | Convexities | | Concavities | Lubricant Zinc Stearate/Zinc Palmitate | Overall |
|---|---|---|---|---|---|
| | Height (μm) | Width (μm) | Area ($\mu m^2$) | (Weight Ratio) | Evaluation Result |
| Ex. 1 | 0.01 | 1 | 1,000 | 45/55 | B |
| Ex. 2 | 0.02 | 1 | 1,000 | 45/55 | A |
| Ex. 3 | 0.1 | 1 | 1,000 | 45/55 | A |
| Ex. 4 | 1 | 1 | 1,000 | 45/55 | B |
| Ex. 5 | 0.1 | 0.5 | 1,000 | 45/55 | B |
| Ex. 6 | 0.1 | 2 | 1,000 | 45/55 | A |
| Ex. 7 | 0.1 | 5 | 1,000 | 45/55 | B |
| Ex. 8 | 0.1 | 1 | 3,000 | 45/55 | B |
| Ex. 9 | 0.1 | 1 | 15,000 | 45/55 | A |
| Ex. 10 | 0.1 | 1 | 30,000 | 45/55 | B |
| Ex. 11 | 0.1 | 1 | 1,000 | 75/25 | B |
| Ex. 12 | 0.1 | 1 | 1,000 | 70/30 | A |
| Ex. 13 | 0.1 | 1 | 1,000 | 40/60 | B |
| Ex. 14 | 0.05 | 1.5 | 900 | 45/55 | C |
| Ex. 15 | 0.05 | 1.5 | 35,000 | 45/55 | C |
| Ex. 16 | 0.05 | 1.5 | 1,000 | 100/0 | C |
| Comp. Ex. 1 | 0.005 | 1 | 1,000 | 45/55 | D |
| Comp. Ex. 2 | 1.5 | 1 | 1,000 | 45/55 | E |
| Comp. Ex. 3 | 0.1 | 0.4 | 1,000 | 45/55 | E |
| Comp. Ex. 4 | 0.1 | 6 | 1,000 | 45/55 | D |

Figure 5A:
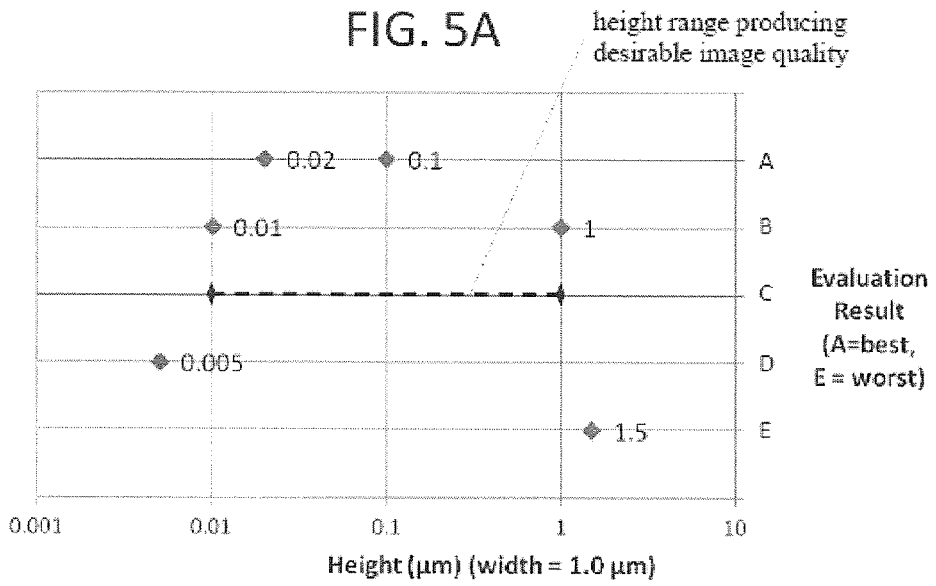
FIGS. 5A and 5B are respective graphs of height and weight, respectively, of convexities obtained in Examples 1-16 and Comparative Examples 1-4.
Figure 5B:
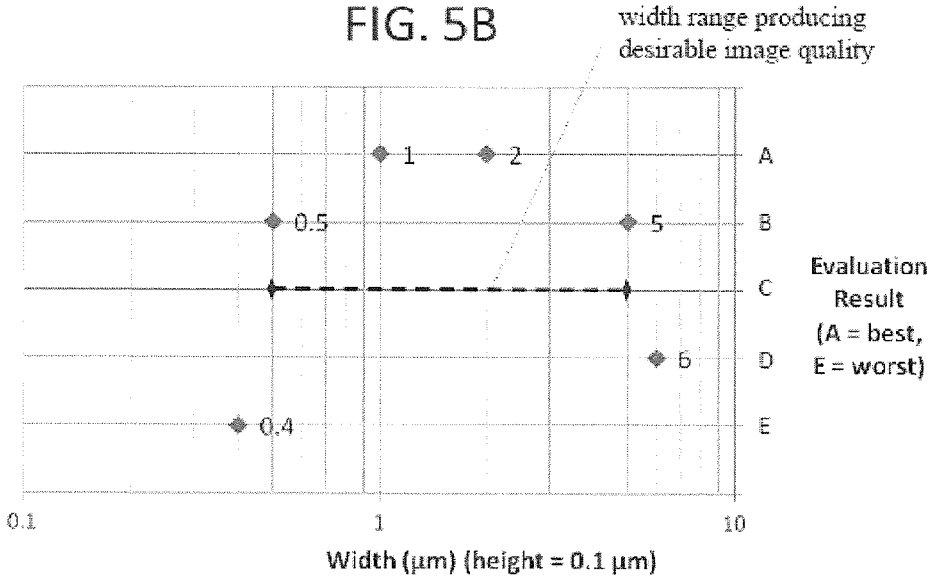

It is clear from Table 1 that when an intermediate transfer belt has linear convexities having a height of from 0.01 to 1 μm (see FIG. 5A) and a width of from 0.5 to 5 μm (see FIG. 5B), more preferably a height of from 0.02 to 0.1 μm and a width of from 1 to 2 μm, and concavities surrounded by the linear convexities have an average area of from 1,000 to 30,000 $\mu m^2$, more preferably from 3,000 to 15,000 $\mu m^2$, lubricant is uniformly applied to the surface of the intermediate transfer belt and the surface friction coefficient of the intermediate transfer belt is effectively reduced. In addition, a zinc stearate-zinc palmitate mixture in which the ratio of zinc stearate to zinc palmitate is from 70/30 to 45/55 is used as the lubricant, the linear convexities effectively exhibit their functions.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-024452 and 2009-149672 filed on Feb. 5, 2008 and Jun. 24, 2009, respectively, the entire contents of which are herein incorporated by reference.

What is claimed is:

1. An electrophotographic image forming method, comprising:

sequentially forming plural single-color toner images on at least one image bearing member;

sequentially transferring the single-color toner images from the at least one image bearing member onto an intermediate transfer belt to form a composite toner image in which the single-color toner images are superimposed on one another, while supplying a metallic soap to the intermediate transfer belt, wherein the intermediate transfer belt to which the metallic soap is supplied includes plural linear convexities in an image forming area of the intermediate transfer belt, and the plural linear convexities have a height of 0.01 μm or greater but not greater than 1 μm, and a width in a range of 0.5 to 5 μm; and transferring the composite toner image from the intermediate transfer belt onto a recording medium.

2. The electrophotographic image forming method according to claim 1, wherein the linear convexities intersect one another to form plural concavities having an average area of from 1,000 to 30,000 $\mu m^2$.

3. The electrophotographic image forming method according to claim 1, wherein the metallic soap is a mixture of a zinc stearate and a zinc palmitate.

4. The electrophotographic image forming method according to claim 1, wherein the intermediate transfer belt moves at a linear speed of 400 mm/sec or more.

5. An electrophotographic image forming apparatus, comprising:

at least one image bearing member configured to bear single-color toner images; and an intermediate transfer belt comprising plural linear convexities in an image forming area of the intermediate transfer belt, wherein the plural linear convexities have a height of 0.01 μm or greater but not greater than 1 μm, and a width in a range of 0.5 to 5 μm, and wherein the single-color toner images are sequentially transferred onto the intermediate transfer belt to form a composite toner image in which the single-color toner images are superimposed on one another, and the composite toner image is transferred onto a recording medium.

6. The electrophotographic image forming apparatus according to claim 5, wherein the linear convexities intersect one another to form plural concavities having an average area of from 1,000 to 30,000 $\mu m^2$.

7. The electrophotographic image forming apparatus according to claim 5, wherein a metallic soap is supplied to the intermediate transfer belt.

8. The electrophotographic image forming apparatus according to claim 7, wherein the metallic soap is a mixture of a zinc stearate and a zinc palmitate.

9. The electrophotographic image forming apparatus according to claim 5, wherein the intermediate transfer belt moves at a linear speed of 400 mm/sec or more.

10. The electrophotographic image forming apparatus according to claim 5, wherein the height and the width of the plural linear convexities are sized such that application of a lubricant to a surface of the intermediate transfer belt is facilitated, the lubricant being configured to reduce a friction coefficient of the surface of the intermediate transfer belt.

11. The electrophotographic image forming apparatus according to claim 5, wherein the plural linear convexities have a height in a range of 0.02 to 0.1 μm and a width in a range of 1 to 2 μm.

* * * * *